United States Patent [19]

Imai et al.

[11] Patent Number: 4,741,984

[45] Date of Patent: May 3, 1988

[54] POSITIVELY CHARGEABLE DEVELOPER

[75] Inventors: Eiichi Imai, Narashino; Takashi Hino, Tokyo, both of Japan

[73] Assignee: Canon Kabushiki Kaisha, Tokyo, Japan

[21] Appl. No.: 865,785

[22] Filed: May 22, 1986

[30] Foreign Application Priority Data

May 29, 1985 [JP] Japan ..... 60-116218

[51] Int. Cl.[4] ..... G03G 9/10

[52] U.S. Cl. ..... 430/106.6; 430/110; 430/137

[58] Field of Search ..... 430/110, 126, 137, 106.6

[56] References Cited

U.S. PATENT DOCUMENTS 4,618,556 10/1986 Takenouchi ..... 430/110

4,626,487 12/1986 Mitsuhashi ..... 430/109

4,640,882 2/1987 Mitsuhashi et al. ..... 430/110

*Primary Examiner*—John L. Goodrow

*Attorney, Agent, or Firm*—Fitzpatrick, Cella, Harper & Scinto

[57] ABSTRACT

A positively chargeable developer, comprising: positively chargeable toner particles, positively chargeable silicate fine powder having a positive triboelectric chargeability higher than that of the toner and a mean particle size of 3 microns or smaller, and a microdisperser having a triboelectric chargeability lower than that of the toner and a mean particle size which is larger than that of the silicate powder and smaller than that of the toner particles. The microdisperser has a function of disintegrating particularly the positively chargeable silicate fine powder and enhances the attachment thereof to the toner particles, whereby the developing characteristics including the triboelectric chargeability are stabilized from the initial stage of electrophotographic copying operation, and the storage stability is also improved.

20 Claims, No Drawings

POSITIVELY CHARGEABLE DEVELOPER

FIELD OF THE INVENTION AND RELATED ART

This invention relates to a developer for developing latent images using image forming methods such as electrophotography, electrostatic recording, electrostatic printing. More particularly, the present invention relates to a developer for electrophotography which is positively charged both uniformly and strongly and gives an image of high quality by visualizing a negative electrostatic image or visualizing a positive electrostatic image by reversal development in the direct or indirect electrophotographic developing method.

It has been practiced in the prior art to form latent images by uniformly charging a photoconductive member and applying a light image exposure corresponding to an original thereby to extinguish the charges at the exposed portion, as described in U.S. Pat. Nos. 2,297,691; 3,666,363; and 4,071,361. Development is carried out by attaching fine powdery electroscopic substance (so-called "toner") on the electrostatic latent image. The toner is attracted to the electrostatic image depending on the amount of charge on the photoconductive layer to form a shaded toner image. The toner image is optionally transferred onto the surface of a support such as paper, plastic film or cloth, and is permanently fixed onto the support surface by heating, pressurization or hot pressurizing rollers. When it is desired to omit the toner image transfer step, the toner image can be also fixed onto the photoconductive layer. Other than the fixing methods; mentioned above, it is also possible to use other means such as solvent treatment or overcoating.

A large number of developing methods have been known in electrophotography, and the developing method such as the cascade developing method using a two-component developer of a mixture of carrier particles and a toner disclosed in U.S. Pat. No. 2,618,552 and the magnetic brush method disclosed in U.S. Pat. No. 2,874,063 have widely been practiced.

All of these methods are excellent methods which can give good images relatively stably. On the other hand, they have common problems of deterioration of carrier and fluctuation in mixing ratio of toner and carrier which are inherent to the use of two-component developers.

In order to circumvent the above problems, various developing methods employing one component developer have been proposed. Among them, many of the methods employing magnetic toner particles are known to be excellent.

U.S. Pat. No. 3,909,258 proposes a developing method which develops electrically by use of a magnetic toner having electroconductivity. According to this method, electroconductive magnetic developer is supported on a cylindrical electroconductive toner carrier (sleeve) having an internal magnet, which developer is then permitted to contact an electrostatic image to effect development. During this operation, an electroconductive path is formed by the toner particles between the surface of a recording member such as a photoconductive layer and the sleeve surface in the developing instrument, and the charges are guided to toner particles through the electroconductive path from the sleeve, whereby the toner particles are attached on the image portion by the Coulomb force between the particles and the image portion of the electrostatic image to effect development.

The developing method using electroconductive magnetic toner is an excellent method which has circumvented the problems inherent in the two component developing method in the prior art. On the other hand, since the toner is electroconductive, there is involved a problem that it is difficult to electrostatically transfer the developed image from a recording member to the final supporting member such as plain paper.

As a developing method employing a high resistance magnetic toner capable of electrostatic transfer, there is a developing method utilizing dielectric polarization of toner particles. However, such a method has problems such that it is an inherently a slow developing method and that a sufficient density of the developed image cannot be obtained, thus involving a difficulty for practical use.

As other developing methods using high resistance magnetic toner, there have been known the methods in which toner particles are charged by mutual friction between the toner particles or between the toner particles and the developer carrier such as a sleeve, and permitted to contact the electrostatic image-bearing member. However, these methods has the problem that triboelectric charge is liable to be insufficient due to minimal contact between the toner particles and the frictional member such as a sleeve, and the charged toner particles are enhanced in Coulomb force between the particles and the sleeve to be readily agglomerated on the sleeve.

A research group to which we belong has previously proposed a novel developing method overcome the above problems in Japanese Laid-Open Patent Application No. 42141/1979 (U.S. Pat. No. 4,356,245). This method comprises applying an insulating magnetic toner in a very small thickness on a sleeve, triboelectrically charging the toner and bringing the toner to a position where it is closely opposed to an electrostatic latent image under the action of a magnetic field and is permitted to jump onto the electrostatic image thereby effecting development. According to this method, excellent image can be obtained because frequency of contact between the sleeve and the toner is increased by coating very thinly a magnetic toner on the sleeve, thereby enabling sufficient triboelectric charging; because the toner is supported by magnetic force and moved relative to the magnet to disintegrate the agglomeration between the toner particles, while being subjected to sufficient friction with the sleeve; and because ground fog is prevented by carrying out development with the toner on the sleeve being opposed to the electrostatic image without contact therewith while restraining the toner with magnetic force.

However, even according to this method, the triboelectric charge possessed by the toner particles coated on the sleeve is smaller as compared with that possessed by the toner particles in the conventional two-component development. When a magnetic toner having only a weak charge is used in this method, such difficulties as lowered image density, scattering, blurring, and image irregularity are liable to occur and therefore improvement in image quality has been still desired. Particularly, the image density at the initial stage of copying (one to tens of sheets) is lower, and some hundreds of copies were generally necesssary before obtaining an image having good high density stably. This instability in rising or initial stage of copying is one of the great problems in one-component developing method. For solving the rising instability, one may consider to improve triboelectric chargeability of the toner. In a negatively chargeable developer it has been known to add silicate fine powder to the developer for overcoming the above problem. In that case, image density and image quality are improved, whereby an image with somewhat satisfactory stability in initial stage characteristic can be obtained. However, silicate fine powder is generally strongly negatively chargeable and it has been difficult to obtain good images if such negatively chargeable silicate fine powder is added to a positively chargeable toner or developer. In the magnetic toner or developer having positive chargeability, no satisfactory triboelectric charging characteristic is obtained by addition of negatively chargeable silica under the present situation.

For the purpose of improving the positive triboelectric charging characteristic, it has been proposed to add a modified silica fine powder obtained by modifying silica fine powder which is inherently negatively chargeable to positively chargeable. For example, as disclosed in Japanese Patent Publication No. 22447/1978, Japanese Laid-Open Patent Application Nos. 185405/1983 or 34539/1984 (U.S. patent application Ser. No. 751,994), there has been proposed a method in which silicate fine powder treated with aminosilane is incorporated in the toner. Further, an attempt is made to incorporate silicate fine powder treated with a silicone oil having an amine in the side chain in the toner or developer (U.S. Pat. No. 4,568,625). By addition of such positively chargeable silicate fine powder, sharp images with high density and relatively little fog can be obtained, but various problems caused by inappropriate triboelectric charging characteristic such as instability in rising cannot fully be solved and further improvement is expected.

SUMMARY OF THE INVENTION

An object of the present invention is to provide a developer having stable and uniform positive chargeability. Another object of the present invention is to provide a toner yielding images with a high image density from the initial stage without rising (or fluctuation of) image density.

Still another object of the present invention is to provide a toner excellent in storage stability which can maintain the initial characteristics even in prolonged storage.

The present invention provides a positively chargeable developer, comprising at least a positively chargeable toner, positively chargeable silicate fine powder with a particle size of 3 microns or less having a higher triboelectric chargeability than said toner, and a microdisperser having a particle size greater than said silicate fine powder and smaller than said toner.

We have found that positively chargeable silicate fine powder exhibits a charge controlling characteristic when it is contained in the developer, and further that the positive charging characteristic is improved and the toner characteristics can be maintained even after storage for a long term when a specific third fine powder (herein referred to as "microdisperser") is mixed into the developer.

The microdisperser has a particle size which is greater than those of the positively chargeable silicate fine powder to be used in the developer of the present invention. The microdisperser alone shows no special transfer of charges to the toner single substance shown in Examples or the toner single substance available in a commercially available plain paper copying machine. Thus, a developer consisting of a toner and a microdisperser shows no effect of improving image quality, but can show no developing ability at all for development of electrostatic latent image in some cases. In contrast, when the microdisperser is added to the developer containing positively chargeable silicate fine powder, improvement in image density as a matter of course, cancellation of instability in initial stage characteristic and maintenance of the characteristics immediately after the toner production after storage for a long term can be recognized, thus accomplishing improvement in the toner developing characteristics to a great extent. When observed through a microscope, in the developer containing none of such a component, much agglomerated masses of positively chargeable toner and agglomerated masses of positively chargeable silicate fine powder can be observed. In contrast, substantially none or very little, if any, of such mass can be recognized in the developer containing a microdisperser.

Since the developer containing a disperser exhibits very good flowability, it can be understood that the microdisperser has the function of dispersing well the positively chargeable silicate fine powder on the surface of the positively chargeable toner. In fact, depending on the presence of microdisperser, the amount of the silicate fine powder attached onto the toner surface or the state of attachment differ greatly. In the developer having a microdisperser, it can be recognized that agglomeration of the silicate fine powder existing on the toner surface is cancelled, simultaneously with good dispersion of the silicate fine powder well attached onto the toner surface. In contrast, in the developer containing no microdisperser, silicate fine powder exists locally at a part of the toner surface like an agglomerated mass. In the developer containing a microdisperser, it has been observed that some microdisperser particles have silicate fine powder attached therearound. From this fact, it may be estimated that the microdisperser has the roles of disintegrating and dispersing agglomerated masses of silicate fine powder; and behaving as a carrier for the silicate fine powder to supply the silicate fine powder to the toner. Accordingly, the microdisperser, in relation to the positively chargeable toner and the positively chargeable silicate fine powder, may be considered to act on the positively chargeable silicate fine powder to cancel its agglomeration simultaneously with supplying rapidly the positively chargeable silicate fine powder to the positively chargeable toner well against the electrostatic repelling force. The reason why the microdisperser acts preferentially on silicate fine powder rather than the toner may be considered to be probably because said silicate fine powder has potentially higher positively chargeable (Q/M) ability than said toner and at the same time the particle size of the silicate fine powder is approximate to the microdisperser.

Such an action is enhanced when the microdisperser is in combination with a stirring means. More specifically, when the developer is left to stand for a long term, the developer will cause deterioration, because the positively chargeable toner and the positively chargeable fine powder are generally liable to be separated from each other to effect agglomeration. For restoration of deterioration of the developer after standing, the toner and the silicate fine powder must be again stirred and mixed. Under the state when left to stand in a developing machine, gradual restoration by means of a stirring means in the developing device must be awaited. In the developer of the present invention containing a microdisperser, since the positively chargeable silicate fine powder is supplied more rapidly by the stirring device to the positively chargeable toner, restoration of the phenomenon of deterioration can be effected extremely rapidly.

The above mentioned and other objects and features of the invention will be better understood upon consideration of the following detailed description concluding with specific examples of practice.

DETAILED DESCRIPTION OF THE INVENTION

In the present invention, the positively chargeable silicate fine powder which is one constituent of the developer should preferably be one with a charge provided under friction with iron powder carrier of +20 μc/g or more. Particularly, it is preferred to exhibit +50 to +300 μc/g and have a value greater than the positively chargeable toner free of said silicate fine powder and microdisperser.

Measurement of a triboelectric charge in the present invention is carried out by mixing about 2 parts by weight of a substance to be tested with about 100 parts by weight of iron carrier having particle sizes of 200/300 mesh (i.e., particles passing a sieve of 200 mesh and remaining on a sieve of 300 mesh). For this operation, the vessel for mixing may preferably be a vessel made of polyethylene, and it is preferred to charge a sample in amount of about 1/5 volume of the vessel and mix the sample by vigorous vertical manual shaking for about one minute. An amount of 0.5 to 1.5 g of the mixture after shaking is accurately measured, aspirated on a 400 mesh screen made of a metal connected to an electrometer under a pressure of 25 cm.$H_2O$, and the charge per unit weight is determined from the weight of the substance to be tested separated by aspiration and the charge thereof as evaluated from the charge remaining on the iron powder carrier.

The particle size of the silicate fine powder of the present invention (inclusive also of the agglomerated silicate fine powder) should preferably be 3 microns or less, particularly about 0.01 to 1 micron. These can be calculated by selecting 20 or more particles from the photography of a transmission type electron microscope and measuring their diameters. The mean particle size used herein is calculated as a number-average value based on the measured values.

The silicate fine powder to be used in the present invention may be the silicate fine powder produce by the dry process or the wet process. Ordinarily, untreated silicate fine powder is negatively chargeable, and good result can not be obtained even when added as such to the developer of the present invention.

The dry process as herein mentioned refers to the process for producing silica fine powder formed by vapor phase oxidation of a silicon halide.

Examples of commercially available silica fine powder formed by vapor phase oxidation of silicon halides to be used in the present invention are shown below.

| | |
|---|---|
| AEROSIL | 130 |
| (Nippon Aerosil Co.) | 200 |
| | 300 |

-continued

| | |
|---|---|
| | 380 |
| | OX50 |
| | TT600 |
| | MOX80 |
| | MOX170 |
| | COK84 |
| Ca-O-Sil | M-5 |
| (CABOT Co.) | MS-7 |
| | MS-75 |
| | HS-5 |
| | EH-5 |
| Wacker HDK N 20 | V15 |
| (WACKER-CHEMIE GMBH) | N20E |
| | T30 |
| | T40 |
| D-C Fine Silica | |
| (Dow Corning Co.) | |
| Fransol | |
| (Fransil Co.) | |

Various known methods are applicable for production of silicate fine powder to be used in the present invention according to the wet process.

Typical example of silicate fine powder is anhydrous silicon dioxide (silica), or otherwise silicates such as aluminum silicate, sodium silicate, potassium silicate, magnesium silicate, zinc silicate or the like may also be used.

Examples of commercially available silicate fine powder synthesized according to the wet process are those sold under the trade names shown below.

| | |
|---|---|
| Carplex | Shionogi Seiyaku K. K. |
| Nipsil | Nippon Silica K. K. |
| Tokusil, Finesil | Tokuyama Soda K. K. |
| Vitasil | Tagi Seihi K. K. |
| Silton, Silnex | Mizusawa Kagaku K. K. |
| Starsil | Kamijima Kagaku K. K. |
| Himesil | Ehime Yakuhin K. K. |
| Siloid | Fuji Davidson Kagaku K. K. |
| Hi-Sil | Pittsburgh Plate Glass Co. |
| Durosil | Fuelstroff Gesellschaft Marquart |
| Ultrasil | " |
| Manosil | Hardman and Holden |
| Hoesch | Chemische Fabrik Hoesch K-G |
| Sil-Stone | Stoner Rubber Co. |
| Nalco | Nalco Chemical Co. |
| Quso | Philadelphia Quartz Co. |
| Imsil | Illinois Minerals Co. |
| Calcium Silikat | Chemische Fabrik Hoesch K-G |
| Calsil | Fuelstoff-Gesellschaft Marquart |
| Fortafil | Imperial Chemical Industries Ltd. |
| Microcal | Joseph Crosfield & Sons Ltd. |
| Manosil | Hardman and Holden |
| Vulkasil | Farbenfabriken Bayer, A. G. |
| Tufknit | Durham Chemicals. Ltd. |
| Silmos | Shiraishi Kogyo K. K. |
| Starlex | Kamijima Kagaku K. K. |
| Furcosil | Tagi Seihi K. K. |

For the purpose of obtaining a developer exhibiting stable and uniform positive chargeability, it has been found effective to impart such a property to the developer by treating the above silicate fine powder with a silicone oil having an amine structure or unit in the side chain.

As the above silicone oil having an amine unit in the side chain to be used for treatment of the silicate fine powder, silicone oils containing the constituent units represented by the formula (I) below ae generally available:

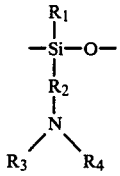

(1)

(wherein $R_1$ represents hydrogen, alkyl, aryl or alkoxy; $R_2$ represents alkylene or phenylene; $R_3$ and $R_4$ each represents hydrogen, alkyl or aryl; with proviso that the above alkyl, aryl, alkylene or phenylene can contain an amine unit, and can also have a substituent such as a halogen atom as far as it does not impair chargeability).

As the commercially available silicone oil having an amine unit in the side chain, amino-modified silicone oils represented by the following structural formula can be preferably used.

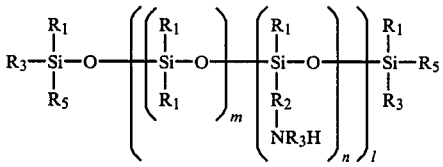

(wherein $R_1$ $R_5$ respectively represent alkyl or aryl; $R_2$ represents phenylene or alkyl containing an amine unit; $R_3$ represents hydrogen, alkyl or aryl; l, m and n are integers of 1 or more). Typical examples of the above silicone oil are shown below. These may respectively be used individually or as a mixture of two or more kinds.

| Trade name | Viscosity at at 25° C. (cps) | Amine equivalent |
|---|---|---|
| SF8417 (Toray Silicone Co.) | 1200 | 3500 |
| KF393 (Shinetsu Kagaku Co.) | 60 | 360 |
| KF857 (Shinetsu Kagaku Co.) | 70 | 830 |
| KF860 (Shinetsu Kagaku Co.) | 250 | 7600 |
| KF861 (Shinetsu Kagaku Co.) | 3500 | 2000 |
| KF862 (Shinetsu Kagaku Co.) | 750 | 1900 |
| KF864 (Shinetsu Kagaku Co.) | 1700 | 3800 |
| KF865 (Shinetsu Kagaku Co.) | 90 | 4400 |
| KF369 (Shinetsu Kagaku Co.) | 20 | 320 |
| KF383 (Shinetsu Kagaku Co.) | 20 | 320 |
| X-22-3680 (Shinetsu Kagaku Co.) | 90 | 8800 |
| X-22-380D (Shinetsu Kagaku Co.) | 2300 | 3800 |
| X-22-3801C (Shinetsu Kagaku Co.) | 3500 | 3800 |
| X-22-3810B (Shinetsu Kagaku Co.) | 1300 | 1700 |

In the present invention, "amine equivalent" refers to an equivalent amount per one amine unit (g/equiv.) which is a value obtained by dividing the molecular weight of a silicone oil with the number of amine units in one molecule. The silicone oil to be used in the present invention should preferably have an amine equivalent of 100 to 4000 for providing positive chargeability.

The amount of the silicone oil having an amine unit in the side chain used for treatment in the present invention may be 0.2 to 70% by weight, preferably 1 to 60% by weight, of the total amount of the treated silicate fine powder.

The silicone oil having an amine unit in the side chain should preferably have a viscosity at 25° C. of 5000 cps or lower, particularly 3000 cps or lower. If the viscosity is higher than 5000 cps, the silicone oil having an amine unit in the side chain can insufficiently be dispersed in the silicate fine powder, whereby poor images with much fog may be formed.

Treatment of the silicate fine powder with the silicone oil having an amine unit in the side chain can be carried out as follows. While stirring vigorously silicate fine powder optionally under heating, the above silicone oil having an amine unit in the side chain or the silicone oil dissolved in an organic solvent is blown thereagainst by spraying or by vaporization, or alternatively the silicate fine powder is formed into a slurry, and the silicone oil having an amine unit in the side chain or its solution is added.

The amount of the thus treated positively chargeable silicate powder applied may be 0.05 to 10% by weight based on the toner weight to exhibit the effect, particularly preferably 0.1 to 3% by weight. As another method for obtaining positively chargeable silicate fine powder in order to obtain a developer exhibiting stable and uniform positive chargeability, it is also effective to impart the above silicate fine powder treated with an aminosilane to the developer.

The aminosilane to be used for the surface treatment of silicate fine powder is an amino-functional silane, which is represented by the following formula:

$$X_mSiY_n$$

(wherein X is an alkoxy or a chlorine atom, m is an integer of 1 to 3, Y is a hydrocarbon group having a primary to tertiary amino group, and n is an integer of 3 to 1). For example, the following compounds may be included.

$H_2N-CH_2CH_2NHCH_2CH_2Si(CH_3)-(OCH_3)_2$ $H_2N-CONH-CH_2CH_2CH_2-Si-(OC_2H_5)_3$ $H_2N-CH_2CH_2CH_2Si(OCH_2CH_3)_3$ $H_2NCH_2CH_2NHCH_2CH_2CH_2Si(OCH_3)_3$ $H_2NCH_2CH_2CH_2Si(OCH_3)_3$ $H_2NCH_2CH_2NHCH_2CH_2NHCH_2CH_2CH_2Si(OCH_3)_3$ $H_5C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NHCH_2CH_2CH_2Si(OCH_3)_3$ $NH_2C_6H_4Si(OCH_3)_3$ $C_6H_5NHCH_2CH_2CH_2Si(OCH_3)_3$

Alternatively, polyaminoalkyltrialkoxysilanes may be employed. These compounds can be used either singly or as a mixture of two or more compounds.

The silicate fine powder to be used in the present invention may be further treated with a known treating agent for imparting hydrophobicity. Known treatment methods may be available and hydrophobicity can be imparted by treating chemically the silicate fine powder with an organic silicon compound which can react with or physically adsorbed onto the silicate fine powder. Such organic silicon compounds may be exemplified by hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing hydroxyl group bonded to each one Si of the unit positioned at the terminal end. These can be used either singly or as a mixture of two or more compounds.

The developer of the present invention comprises a microdisperser as another important constituent. The microdisperser should preferably be formed of a metalloid oxide or a metal oxide, particularly an oxide, including a double or complex oxide, of a metal element or a metalloid element positioned at the fourth period or higher in the periodic table. The microdisperser is about 0.1 to 5 microns in size, having a mean particle size smaller than the toner and greater than the silicate fine powder used in combination. The particle size of these microdispersers can be measured according to the same method as used for silicate fine powder. The amount of the microdisperser added sould preferably be about 0.5 to 10 wt. % based on the toner. Particularly, preferable results can be obtained when the amount is more than the amount of the silicate fine powder added to the toner. Further, the microdisperser should preferably have a lower chargeability than the positively chargeable silicate fine powder and further a lower chargeability than the positively chargeable toner, in order to take in sufficiently the silicate fine powder and deliver it to the toner.

In the positively chargeable developer of the present invention, it is preferred to formulate 0.1 to 3 parts by weight of the positively chargeable silicate fine powder and 0.5 to 10 parts by weight of the microdisperser with respect to 100 parts by weight of the toner in view of charging characteristic and durability.

In the present invention, preferable results can be exhibited when the positively chargeable toner has a charging characteristic of +5 to +50 μc/g according to the measurement method as described above, while the microdisperser may have a value lower than that of the toner, which is generally about 10 μc/g or lower, to give good results. The particle size and charging characteristic of the microdisperser as mentioned above are important in the action of the microdisperser on the silicate fine powder, and therefore should be selected carefully.

Examples of the microdisperser include particles of oxides inclusive of bismuth oxide such as $Bi_2O_3$, molybdenum oxide such as $MoO_2$ and $MoO_3$, vanadium oxide such as $V_2O_3$, nickel oxide such as NiO, and manganese oxide such as $Mn_2O_3$.

Known binder resins are available for the toner to be used in the present invention. For example, it is possible to use homopolymers of styrene and its substituted derivatives such as polystyrene, poly-p-chlorostyrene, polyvinyltoluene; styrene copolymers such as styrene-p-chlorostyrene copolymer, styrene-propylene copolymer, styrene-vinyl toluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid half ester copolymer, styrene-maleic acid ester copolymer; polymethyl methacrylate, polybutyl methacrylate, polyvinyl chloride, polyvinyl acetate, polyethylene, polypropylene, polyester, polyurethane, epoxy resin, polyvinylbutyral, polyamide, polyacrylic acid resin, rosin, modified rosin, terpene resin, phenol resin, aliphatic or alicyclic hydrocarbon resin, aromatic petroleum resin, chlorinated paraffin, paraffin, wax, either alone or as a mixture. Among them, styrene resins such as polystyrene or styrene copolymer, polyester resins and acrylic resins are preferable in view of thermal fixing characteristic, and developing durability or successive developing characteristic. For a pressure fixable toner, wax is preferred.

The magnetic toner obtained by incorporating a magnetic material in a binder resin when formed into particles may have a particle size of 30 microns or less, preferably 5 to 30 microns which is the toner particle size in general. When the mean particle size of the toner is 10 microns or less in terms of volume-average particle size, the developing characteristic of the positively chargeable developer of the present invention can be further improved.

As the magnetic material to be contained in the toner, ferromagnetic elements, alloys containing these, for example, alloys or compounds of iron, cobalt, nickel, manganese, etc., such as magnetite, hematite, ferrite and other ferromagnetic alloys can be suitably used. The magnetic material also serves as a colorant.

The particle size of the magnetic material may be 100 to 800 mμ, preferably 300 to 500 mμ, and it is preferably contained in an amount of 30 to 100 parts by weight, more preferably 40 to 90 parts by weight, per 100 parts by weight of the binder resin.

Additives such as charge controlling agents, flow improvers, colorants, lubricants may be incorporated, if desired, without deviating from the present invention.

When the positively chargeable toner according to the present invention is substantially nonmagnetic, the particle size of the toner should preferably be 30 microns or smaller, particularly 1 to 10 microns in terms of a volume-average particle size.

As the colorant, it is possible to use dyes or pigments known in the art such as carbon black, iron black, Ultramarine Blue, Nigrosine dye, Aniline Blue, Phthalocyanine Blue, Phthalocyanine Green, Hansa Yellow G, Rhodamine 6G lake, Chalcoil Blue, Chrome Yellow, quinacridone, Benzidine Yellow, Rose Bengal, triallylmethane, diallylmethane, anthraquinone, monoazo, disazo dyes or pigments, either alone or as a mixture. The colorant may be used in an amount of generally 0.5 to 30 parts by weight per 100 parts by weight of the binder resin.

Illustrative of the positive charge controlling agent are nigrosine, azine dyes, quaternary ammonium salts, guanidine compounds, triazine compounds and dialkyltin oxides. The positive charge controlling agent is added in an amount of generally about 0.1 to 10 parts by weight based on 100 parts by weight of the binder resin.

In preparation of the toner of the present invention, there may be adopted a method in which constituent materials are well kneaded by a hot kneading machine such as hot roll, kneader or extruder, then the kneaded product is cooled and crushed by means of a mechanical crushing means, and the crushed product is classified.

It is also possible to apply the method of obtaining a toner in which a material such as magnetic powder is dispersed in a binder resin solution, and the dispersion is then spray dried, or the toner preparation method in which an emulsion or suspension containing the constituent materials dispersed in a polymerizable monomer providing the binder resin is polymerized to give a toner.

Recently, for the purpose of separating the required functions of a toner, microencapsulated toner has been proposed. The present invention can also be applied to a developer containing a microcapsule toner.

As the method for mixing positively chargeable silicate fine powder and microdisperser with said toner, rotary vessel type mixers such as a V type mixer and Turbula mixer; stationary vessel type mixers such as a ribbon-type, a screw-type, a rotary blade-type mixer may be used.

The three components may be mixed at a time during mixing, or alternatively in a successive order in view of the properties of the toner. Further, a known fourth substance can be also added. For example it is possible to add polyethylene fluoride, polyvinylidene fluoride, aliphatic metal salts, various abrasives within an extent not adversely affecting the present invention.

The present invention is described in more detail by referring to the following Examples, in which "parts" indicate "parts by weight".

EXAMPLE 1

A toner of 5 to 20 microns (number-average size 15.3 microns) comprising 100 parts of a polystyrene (D-125, produced by Hercules Inc.), 50 parts of magnetite (EPT-500, produced by Toda Kogyo K.K.) and 5 parts of nigrosine dye was obtained in a conventional manner including melt-kneading and crushing. A developer comprising 100 parts of the toner, one part of a treated silica (number-average size: 0.2 micron) obtained by treating colloidal silica (Aerosil #200, produced by Nippon Aerosil) with an amino-modified silicone oil (viscosity: 20 cps, amine equivalent: 320), and 5 parts of bismuth oxide ($Bi_2O_3$, number-average size: 2.2 microns) was prepared by mixing and applied to a commercially available plain paper copying machine (NP-150Z, produced by Canon K.K.). As a result, a very sharp image with a reflection density of 1.2 to 1.4 and free of fog could be obtained from the first sheet. When 200 sheets of copying were performed, the same good density as in the first sheet was obtained and no fluctuation in density was observed. Further, after the developer was left to stand for 40 days, copied image was again obtained and it was found to have the same image density of a reflection density of 1.2 to 1.4 as the initial stage, thus providing a very sharp image free of fog.

The triboelectric charges of the toner, the positively chargeable silicate fine powder and bismuth oxide were measured according to the method as described above to obtain the values of +15 μc/g, about +200 μc/g and about +3 μc/g, respectively.

EXAMPLE 2

A toner of 5 to 20μ (number-average size: 15.3μ) comprising 100 parts of a polysyrene (D-125, produced by Hercules Inc.), 50 parts of magnetite (EPT-500, produced by Toda Kogyo K.K.) and 5 parts of nigrosine dye was obtained in a conventional manner. A developer comprising 100 parts of the toner, 0.5 part of a treated silica (number-average size: 0.08μ) obtained by treating colloidal silica (Aerosil #200, produced by Nippon Aerosil K.K.) with aminosilane and hydrophobic modifying agent in the manner as described above, and 2 parts of molybdenum oxide $MoO_2$, number-average size: 2.2μ), was prepared and applied to a commercially available plain paper copying machine (NP-150Z, produced by Canon K.K.). As a result, a very sharp image with a reflection density of 1.2 to 1.4 and free of fog could be obtained from the first sheet. When 200 sheets of copying were performed, the same good density as in the first sheet was obtained and no fluctuation in density was observed. Further, after the developer was left to stand for 40 days, copied image was again obtained and it was found to have the same image density of a reflection density of 1.2 to 1.4 as the initial stage, thus providing a very sharp image free of fog.

The triboelectric charge of the positively chargeable silicate fine powder was about +90 μc/g. The triboelectric charge of molybdenum oxide was slightly lower than that of the toner.

EXAMPLE 3

A toner of 5 to 20 microns (number-average size: 11.5 microns) comprising 100 parts of a styrene 2-ethylhexyl acrylate copolymer (produced by Sanyo Kasei K.K.), 50 parts of magnetite (EPT-500, produced by Toda Kogyo K.K.), and 5 parts of dibutyltin oxide was obtained in a conventional manner. A developer comprising 100 parts of the toner, 0.5 part of a treated silica (number-average size: 0.08 micron) of colloidal silica (Aerosil #200, produced by Nippon Aerosil K.K.) treated with aminosilane and hydrophobic modifying agent as described above and 0.8 part of vanadium oxide ($V_2O_3$, number-average size: 1.8 micron) was prepared by mixing and applied to a commercially available plain paper copying machine (NP-150Z, produced by Canon K.K.). As a result, a very sharp image with a reflection density of 1.2 to 1.4 free of fog could be obtained from the first sheet. When 200 sheets of copying were performed, the same good density as in the first sheet was obtained and no fluctuation in density was observed. Further, after the developer was left to stand for 40 days, copied image was again obtained and it was found to have the same image density of reflection density of 1.2 to 1.4 as the initial stage, thus providing a very sharp image free of fog.

The triboelectric charge of the toner was about +25 μc/g. The triboelectric charge of vanadium oxide was slightly lower than that of the toner.

EXAMPLE 4

A toner of 5 to 20 microns (number-average size: 11.5 microns) comprising 100 parts of a styrene 2-ethylhexyl acrylate copolymer (produced by Sanyo Kasei K.K.), 50 parts of magnetite (EPT-500, produced By Toda Kogyo K.K.), and 5 parts of dibutyltin oxide was obtained in a conventional manner. A developer comprising 100 parts of the toner, 1 part of a treated silica (number-average size: 0.2 micron) obtained by treating colloidal silica (Aerosil #200, produced by Nippon Aerosil K.K.) with the amino-modified silicone oil and 3 parts of nickel oxide (NiO, number-average size: 0.5 micron) was prepared by mixing and applied to a commercially available plain paper copying machine (NP-150Z, produced by Canon K.K.). As a result, a very sharp image with a reflection density of 1.2 to 1.4 and free of fog could be obtained from the first sheet. When 200 sheets of copying were performed, the same good density as in the first sheet was obtained and no fluctuation in density was observed. Further, after the developer was left to stand for 40 days, copied image was again obtained and it was found to have the same image density of a reflection density of 1.2 to 1.4 as the initial stage, thus providing a very sharp image free of fog.

The triboelectric charge of nickel oxide was slightly lower than that of the toner.

EXAMPLE 5

A toner of 5 to 20 microns (number-average size: 11.5 microns) comprising 100 parts of a styrene 2-ethylhexyl acrylate copolymer (produced by Sanyo Kasei K.K.), 50 parts of magnetite (EPT-500, produced by Toda Kogyo K.K.), and 5 parts of dibutyltin oxide was obtained in a conventional manner. A developer comprising 100 parts of the toner, 2 parts of a treated silica (number-average size: 0.08 micron) obtained by treating colloidal silica (Aerosil #200, produced by Nippon Aerosil K.K.) with the aminosilane and the hydrophobic modifying agent as described above, and 8 parts of manganese oxide ($Mn_2O_3$, number-average size: 4 microns) was prepared by mixing and applied to a commercially available plain paper copying machine (NP-150Z, produced by Canon K.K.). As a result, a very sharp image with a reflection density of 1.2 to 1.4 and free of fog could be obtained from the first sheet. When 200 sheets of copying were performed, the same good density as in the first sheet was obtained and no fluctuation in density was observed. Further, after the developer was left to stand for 40 days, copied image was again obtained and it was found to have the same image density of a reflection density of 1.2 to 1.4 as the initial stage, thus providing a very sharp image free of fog.

The triboelectric charge of manganese oxide was slightly lower than that of the toner.

COMPARATIVE EXAMPLE 1

The same experiment as Example 1 was conducted except for adding no bismuth oxide. As a result, the initial image had a reflection density of 0.8 to 1.0, was slightly fogged, and accompanied with some toner scattered around the letter images. When copying was further continued, the reflection density changed and became 1.2 to 1.4 after copying of about 50 to 150 sheets. Further, after the developer was left to stand for 40 days, copying was performed again. The obtained copied image had a reflection density of 0.6 to 0.8, with more fog and inferior with excessive scattering of tone around letter images as compared with that obtained in Example 1.

COMPARATIVE EXAMPLE 2

The same experiment as Example 2 was conducted except for adding no molybdenum oxide. As a result, the initial image had a reflection density of 0.8 to 1.0, was slightly fogged, and accompanied with some toner scattered around the letter images. When copying was further continued, the reflection density changed and became 1.2 to 1.4 after copying of about 50 to 150 sheets. Further, after the developer was left to stand for 40 days, copying was performed again. The obtained copied image had a reflection density of 0.6 to 0.8, with more fog and inferior with excessive scattering of toner around letter images as compared with that obtained in Example 2.

COMPARATIVE EXAMPLE 3

The same experiment as Example 3 was conducted except for adding no vanadium oxide. As a result, the initial image had a reflection density of 0.8 to 1.0, was slightly fogged and accompanied with scattering of toner around the letter images. When copying was further continued, the reflective density changed and became 1.2 to 1.4 after copying of about 50 to 150 sheets. Further, after the developer was left to stand for 40 days, copying was performed again. The obtained copied image had a reflection density of 0.6 to 0.8, with more fog and inferior with excessive scattering of toner around letter images as compared with that obtained in Example 3.

COMPARATIVE EXAMPLE 4

The same experiment as Example 4 was conducted except for adding no nickel oxide to obtain only the same result as in Comparative Example 3.

COMPARATIVE EXAMPLE 5

The same experiment as Example 5 was conducted except for adding no manganese oxide to obtain only the same result as in Comparative Example 3.

COMPARATIVE EXAMPLE 6

The same experiment as Example 3 was conducted except for using colloidal silica (Aerosil #200) not treated with the amino-modified silicone oil for imparting positive chargeability. As a result, the initial image had a reflective density of 0.8 to 1.0, was slightly fogged, and accompanied with scattering of toner around the letter images. When copying was further continued, the reflection density remained low.

COMPARATIVE EXAMPLE 7

The same experiment as Example 2 was conducted except for adding no positively chargeable silicate fine powder. As a result, the initial image had a reflective density of 0.4 to 0.6, was slightly fogged, and accompanied with toner scattering around the letter images. When copying was further continued, the reflection density remained as low as about 0.5 to 0.6 even after 2000 sheets of copying. Further, after the developer was left to stand for 40 days, copying was performed to give a copied image with a reflection density of 0.6 to 0.8, which was more fogged and inferior with excessive scattering of toner around the letter images than Example 2.

EXAMPLE 6

A toner of 1 to 15 microns (number average size: 7.3 microns; volume average particle size: about 9 microns) comprising 100 parts of a styrene butyl methacrylate copolymer (copolymerization weight ratio: 65:35, weight-average molecular weight: about 60,000), 50 parts of magnetite (mean particle size: about 0.13 micron) and 5 parts of nigrosine dye was obtained in a conventional manner. A developer comprising 100 parts of the toner, one part of a treated silica (number-average size 0.2 micron) obtained by treating colloidal silica (Aerosil #200, produced by Nippon Aerosil) amino-modified silicone oil (viscosity: 20 cps, amine equivalent: 320), and 5 parts of bismuth oxide ($Bi_2O_3$, length average size: 2.2 microns), was prepared by mixing and applied to a commercially available plain paper copying machine (NP-150Z, produced by Canon K.K.). As a result, a very sharp image with a reflection density of 1.3 to 1.4 and free of fog could be obtained from the first sheet. When 200 sheets of copying were performed, the same good density as in the first sheet was obtained and no fluctuation in density was observed. Further, after the developer was left to stand for 40 days, copied image was again obtained and it was found to have the same image density of a reflection denisty of 1.2 to 1.4 as the initial stage, thus providing a very sharp image free of fog. When a fine line image of 250 lines per inch was copied, good copied image was obtained, whereby it was confirmed that excellent reproducibility of fine line image could be obtained.

Further, due to presence of the microdisperser and the positively chargeable silica, appearance of toner agglomerated mass as ordinarily observed in small particle size toners was inhibited.

The triboelectric charges of the toner, the positively chargeable silicate fine powder and bismuth oxide were measured according to the method as described above to obtain the values of about +48 μc/g, about +200 μc/g and about +3 μc/g, respectively.

What is claimed is:

1. A positively chargeable developer, comprising:
positively chargeable toner particles containing a binder resin, a colorant or magnetic material and a positive charge controlled agent;
positively chargeable silicate fine powder having a positive triboelectric chargeability higher than that of the toner and a mean particle size of 3 microns or smaller; and
a microdisperser having a triboelectric chargeability lower than that of the toner and a mean particle size which is larger than that of the silicate powder and smaller than that of the toner particles.

2. A developer according to claim 1, wherein said positively chargeable silicate fine powder has such a positive chargeability as to show a triboelectric charge of +20 μc/g or more when measured after friction with iron powder carrier.

3. A developer according to claim 2, wherein said positively chargeable silicate fine powder shows a triboelectric charge of +50 to +300 μc/g.

4. A developer according to claim 1, wherein said positively chargeable silicate fine powder has a mean particle size of about 0.01 to 1 micron.

5. A developer according to claim 1, wherein said positively chargeable silicate fine powder has been obtained by surface-treating silicate fine powder produced through the dry process with a silicone oil having an amine unit in the side chain thereof.

6. A developer according to claim 1, wherein said positively chargeable silicate fine powder has been obtained by surface-treating silicate fine powder produced through the dry process with an aminosilane represented by the following formula:

$$X_mSiY_n$$

wherein X is an alkoxy or a chlorine atom, m is an integer of 1 to 3, Y is a hydrocarbon group having a primary to tertiary amino group, and n is an integer of 3 to 1 satisfying the relationship of $m+n=4$.

7. A developer according to claim 1, wherein said microdisperser comprises particles of an oxide of a metal or metalloid element.

8. A developer according to claim 7, wherein said metal or metalloid element is positioned at the fourth or higher period in the periodic table.

9. A developer according to claim 1, wherein said microdisperser has a mean particle size of about 0.1 to 5 microns.

10. A developer according to claim 1, wherein said microdisperser is contained in an amount of 0.5 to 10 wt. % based on the toner particles.

11. A developer according to claim 1, wherein said microdisperser comprises particles of an oxide selected from the group consisting of bismuth oxide, molybdenum oxide, vanadium oxide, nickel oxide, and manganese oxide.

12. A developer according to claim 1, wherein said toner particles have a mean particle size of 30 microns or smaller.

13. A developer according to claim 12, wherein said toner particles comprise at least a binder resin, and a magnetic material or a colorant.

14. A developer according to claim 13, wherein said toner particles further comprise a positive charge controlling agent in an amount of about 0.1 to 10 parts by weight based on 100 parts by weight of the binder resin.

15. A developer according to claim 1, wherein said toner particles contain a magnetic material and have a mean particle size of 5 to 30 microns and a positive chargeability of +5 to +50 μc/g; said silicate fine powder has a positive chargeability of +50 to +300 μc/g and is contained in an amount of 0.1 to 3 parts per 100 parts by weight of said toner.

16. A develoepr according to claim 15, wherein said toner particles contain 30 to 100 parts of the magnetic material per 100 parts by weight of the binder resin.

17. A developer according to claim 1, wherein said toner particles contain 0.5 to 30 parts of the colorant per 100 parts by weight of the binder resin.

18. A developer according to claim 17, wherein said toner particles have a mean particle size of 1 to 10 microns.

19. A developer according to claim 14, wherein said positive charge controlling agent is a compound selected from the group consisting of nigrosine, azine dyes, quaternary ammonium salts, guanidine compounds, triazine compounds and dialkyltin oxides.

20. A developer according to claim 1, which is a one component developer.

* * * * *

UNITED STATES PATENT AND TRADEMARK OFFICE

CERTIFICATE OF CORRECTION

PATENT NO. : 4,741,984

DATED : May 3, 1988

INVENTOR(S) : EIICHI IMAI, ET AL.

It is certified that error appears in the above-identified patent and that said Letters Patent is hereby corrected as shown below:

COLUMN 7

Line 29, "$R_1$ $R_5$" should read --$R_1$ and $R_5$--.

COLUMN 12

Line 16, "$MoO_2$, number-aver-" should read --$MoO_2$, (number-aver---.

COLUMN 15

Line 38, "controlled" should read --controlling--.

COLUMN 16

Line 46, "toner." should read --toner; and said microdisperser has a mean particle size of 0.1 to 5 microns and is contained in an amount of 0.5 to 10 parts per 100 parts by weight of said toner.--.

Line 47, "develoepr" should read --developer--.

Signed and Sealed this

Twenty-fifth Day of October, 1988

*Attest:*

DONALD J. QUIGG

*Attesting Officer*

*Commissioner of Patents and Trademarks*